United States Patent [19]

Heatlie

[11] Patent Number: 4,738,608

[45] Date of Patent: Apr. 19, 1988

[54] UNIT FOR MOLDING CONCRETE MIX

[76] Inventor: John B. Heatlie, 101 Hope St., Geelong West, Victoria 3218, Australia

[21] Appl. No.: 14,437

[22] Filed: Feb. 13, 1987

[30] Foreign Application Priority Data

Feb. 13, 1986 [AU] Australia ..... PH04594

[51] Int. Cl.[4] ..... A01J 17/00

[52] U.S. Cl. ..... 425/209; 425/542; 425/428; 366/64; 366/196; 406/101; 222/414

[58] Field of Search ..... 425/209, 253, 447, 428, 425/425, 542; 264/349; 366/64, 67, 195, 196; 417/900; 415/125, 129, 133, 140; 406/101; 222/333, 410, 414

[56] References Cited

U.S. PATENT DOCUMENTS

| | | | |
|---|---|---|---|
| 1,477,586 | 12/1923 | Patterson | 366/183 |
| 1,828,712 | 10/1931 | Hirsch | 406/101 |
| 1,879,828 | 9/1932 | Smith et al. | 366/194 |

FOREIGN PATENT DOCUMENTS

| | | | |
|---|---|---|---|
| 209887 | 8/1957 | Australia . | |
| 241970 | 12/1962 | Australia | 425/447 |
| 427457 | 8/1972 | Australia . | |
| 580037 | 7/1933 | Fed. Rep. of Germany | 366/64 |

*Primary Examiner*—Bernard Nozick

*Attorney, Agent, or Firm*—Lockwood, Alex, Fitzgibbon & Cummings

[57] ABSTRACT

A unit for moulding concrete mix, asphalt or other flowable material is disclosed which has a plurality of paddles mounted on a rotatable paddle wheel. The paddles compact and extrude the material into and through a mould box.

5 Claims, 4 Drawing Sheets

UNIT FOR MOLDING CONCRETE MIX

The present invention relates to a unit for moulding materials of the type including concrete, asphalt, sand or other mouldable material and is concerned more particularly with the continuous formation of concrete or the like structures such as kerbs or guttering.

Examples of such units are described in Australian patent specification Nos. 209,887 and 427,457. In these specifications there are disclosed units for moulding concrete mix comprising an open ended mould box provided with an open lower side, the mould box being mounted on a base, a consolidating and propelling means also mounted on the base and slidable within a ramming chamber associated with the mould box to effect the consolidation and moulding of concrete mix in the mould box to conform the concrete mix to the shape of the mould box and at the same time move the unit from the newly consolidated and moulded concrete mix. The consolidating and propelling means comprises a ram plate which is either mounted for reciprocal or pivotal movement. Although satisfactory, these units may not provide adequate compaction, especially when the ram plate is withdrawn after its ramming stroke. The backwards movement of the ram plate after the ramming stroke allows the concrete to expand slightly and decrease compaction.

It is an object of the present invention to overcome the disadvantage just referred to and to maintain a more constant thrust on the concrete mix or other mouldable material.

With this object in view the present invention provides a unit for moulding mouldable material, especially concrete mix, asphalt or similar flowable material, said unit including means for permitting the material to be fed into a ramming chamber, consolidating and propelling means mounted to operate in conjunction with said chamber to compact and extrude the material into and through a mould box, said consolidating and propelling means including a plurality of paddles connected between a rotatable paddle wheel, said paddles compacting and extruding said material into said mould box.

Preferably said paddles are pivotally attached to said paddle wheel and the angle of attack of each paddle is controllable. In one preferred embodiment the angle of attack of each paddle is controlled by a cam follower on each paddle co-operating with a cam track on said unit. Preferably each paddle is composed of an obtusely angled member.

A practical embodiment of the invention will now be described with reference to the non-limitative example illustrated in the accompanying drawings, in which.

Figure 3:
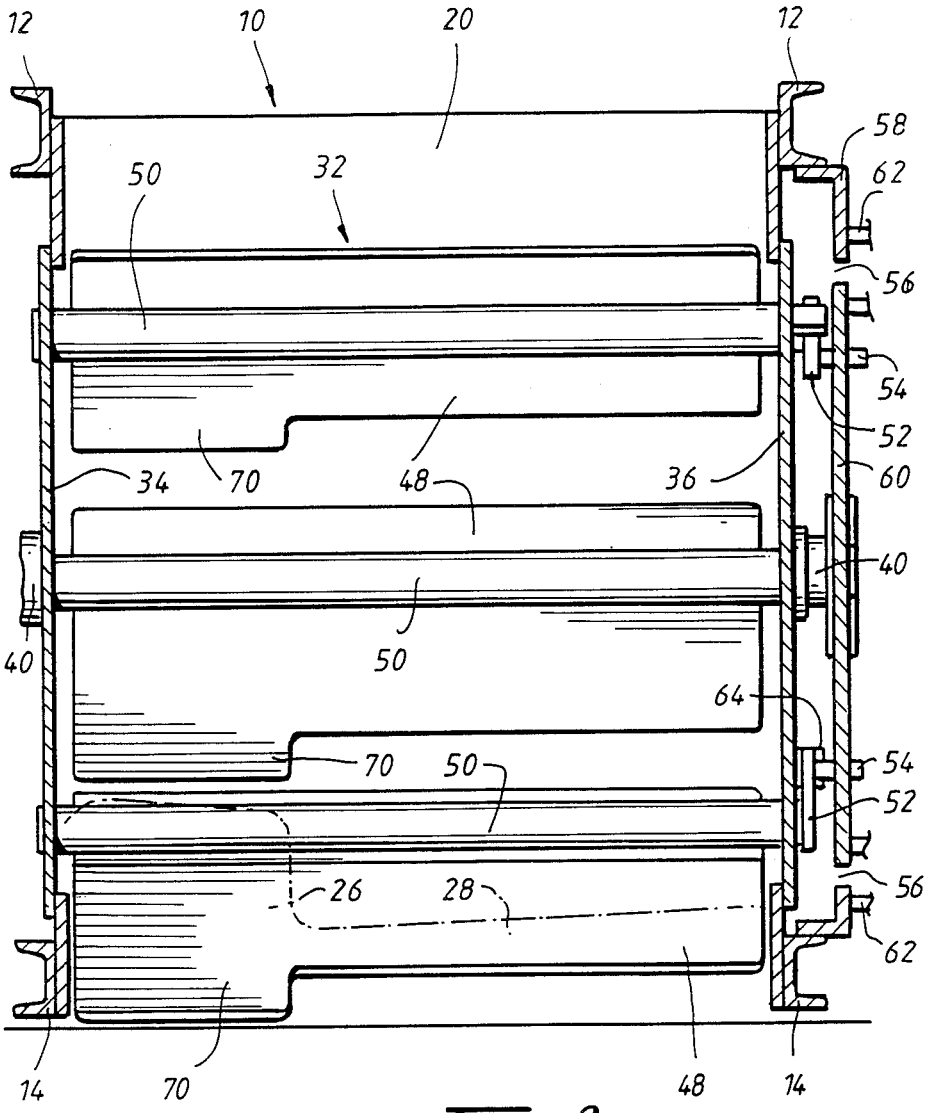
FIG. 3 is a cross-sectional view of the unit shown in FIG. 1 along and in the direction of arrows 3—3 of FIG. 2.

In the drawings the unit 10 has upper and lower longitudinal frame members 12,14 and end frame members 16 to form the major framework for the unit. Concrete can enter a ramming chamber 18 through an open top 20 in the unit. In front of ramming chamber 18 is a mould box 22 having a cross-sectional shape which corresponds to the desired shape of the formed concrete. The mould box is open-ended and is open-bottomed at 24. In FIG. 3 it is shown that the mould box (in phantom lines) consists of a vertical leg 26 providing for the formation of a kerb, and a lateral leg 28 providing for the formation of a channel or gutter extending from the kerb. Naturally the shape of the mould box will vary according to requirements. A curved deflector plate 30 defines an end wall for a hopper for the concrete which enters open top 20.

To compact and extrude concrete through mould box 22 a paddle wheel 32 is provided. Paddle wheel 32 includes two disks 34,36 connected by a central axle 40 which rotates paddle wheel 32. A motor 42 e.g. electric motor, internal combustion engine or hydraulic motor is mounted on support bracket 44 and is coupled via belt or chain 46 to paddle wheel 32. Motor 42 causes paddle wheel 32 to be rotated continuously. A plurality of paddles 48, six in this embodiment, are pivotally attached between disks 34,36. Each paddle 48 is an obtuse angled member and includes a shaft 50 journalled at each end to disks 34,36. At one end of shaft 50 is a radial arm 52 which has a transverse cam follower 54 mounted thereon. If required, radial arms 52 may be adjustable. A cam track 56 is formed by a first side wall member 58 and complementary second side wall member 60 which is co-planar therewith. The second side wall member 60 is secured to first side wall member 58 by brackets 62 joining the two wall members. In the illustrated embodiment cam track 56 is formed by tne spacing between the two wall members but is only effective in a 180° arc. Outside of cam track 56 the paddles 48 may swing freely with their movement being constrained by stop members 64 welded to disk 36. If required additional stop members (not shown) may be attached to limit swinging movement in the opposite direction.

In use, the unit 10 is controlled by a steering tiller (not shown) and telescoping assembly handles 66 whereby the operator maintains a guide pointer (not shown) on the unit closely adjacent to and level with a pre-set guide cord which defines the line of the concrete formation to be placed and moulded. The operator may also, by the same means, and by observance of a cross-level indicator (not shown) affixed to the framework, maintain the unit at true cross-level. Turning the telescoping assembly handles 66 will, in relation to the basic framework, screw wheel 68 up or down to compensate for ground irregularities. This means of compensating for ground irregularities represents a very considerable saving in labour, which would otherwise be required to prepare the subgrade without any depth tolerance.

Figure 1:
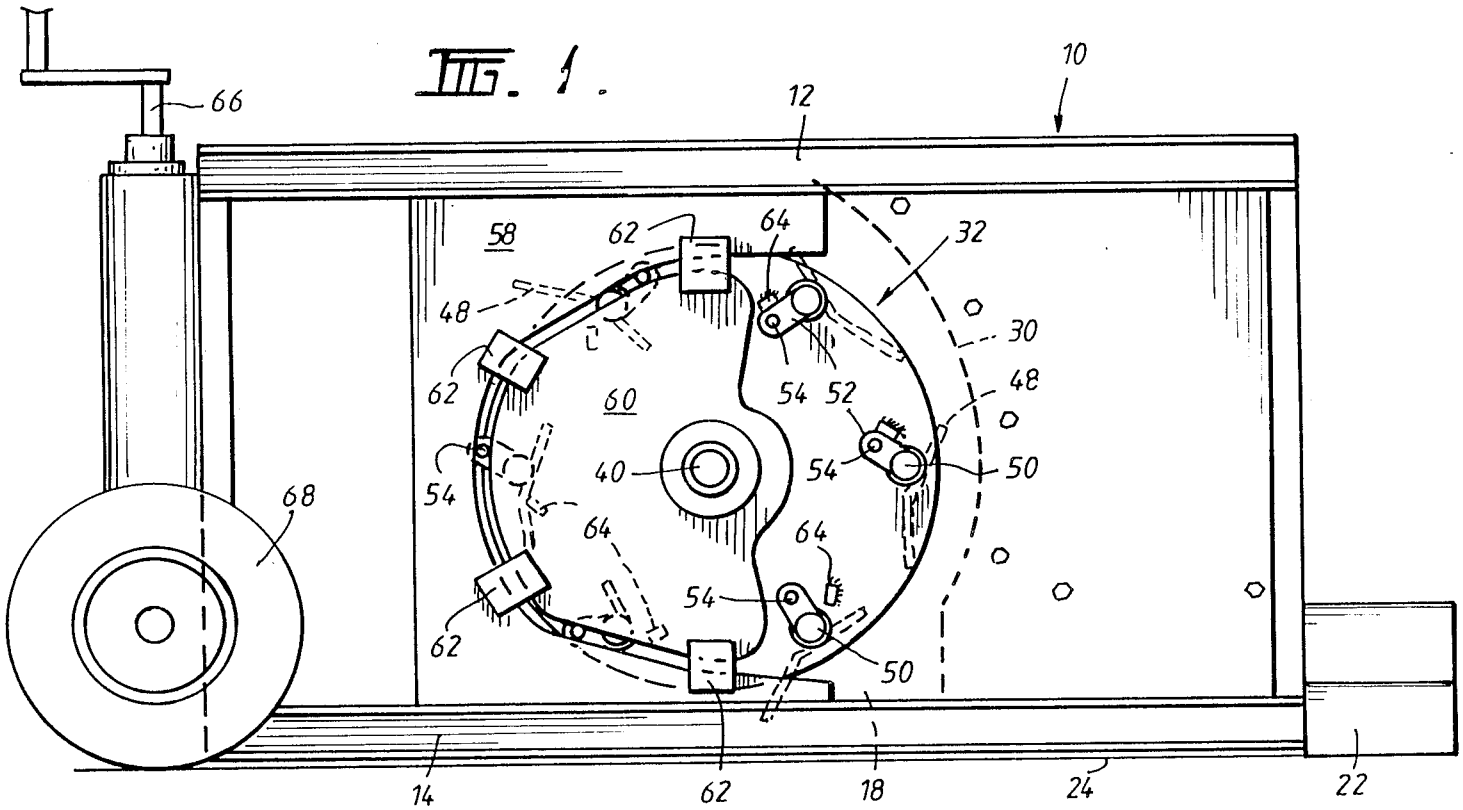
FIG. 1 is a elevational view, with the side panel removed, of a unit incorporating the features of the present invention.
Figure 2:
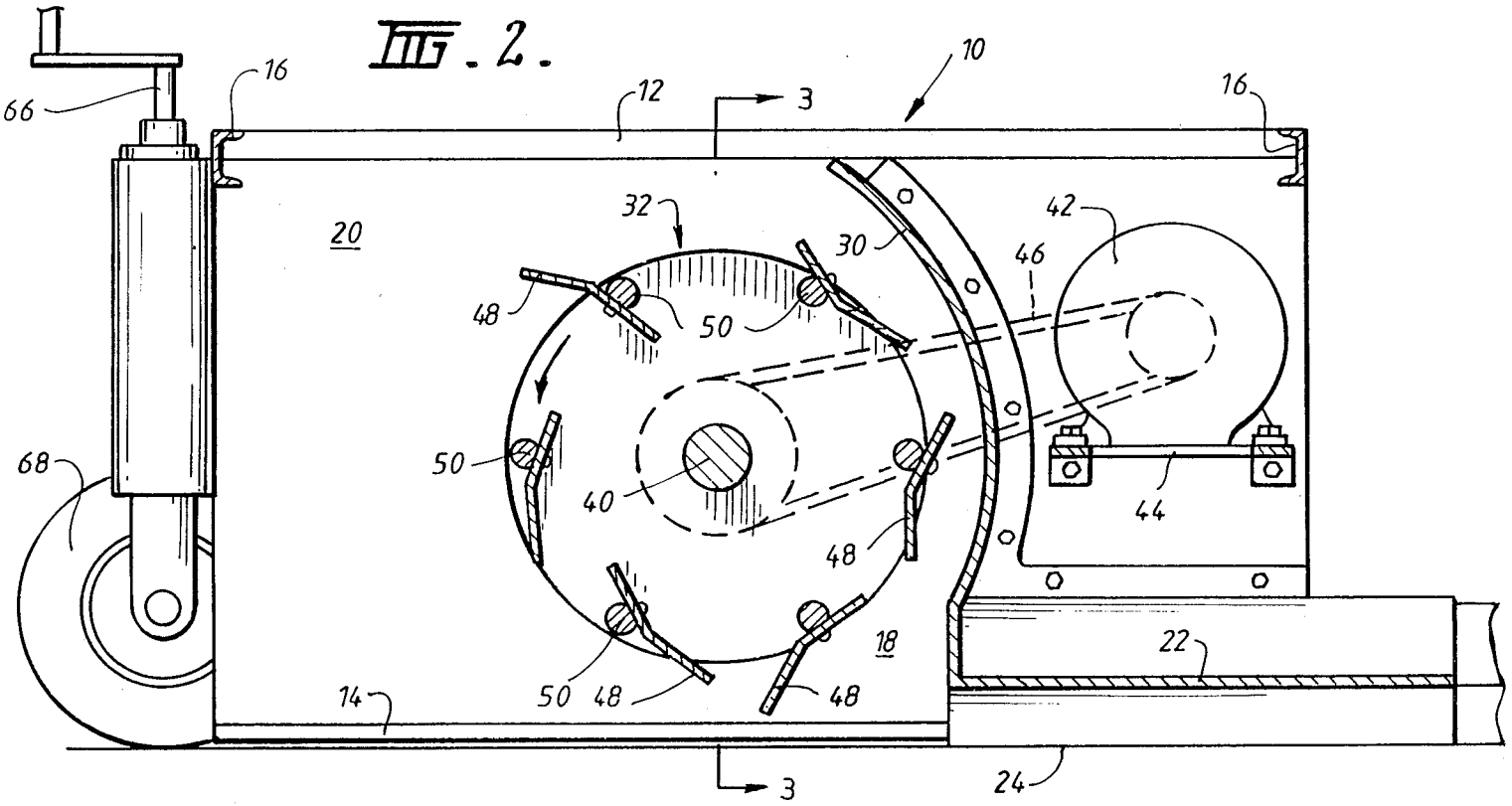
FIG. 2 is a longitudinal cross-sectional view of the unit shown in FIG. 1.
Figure 4:
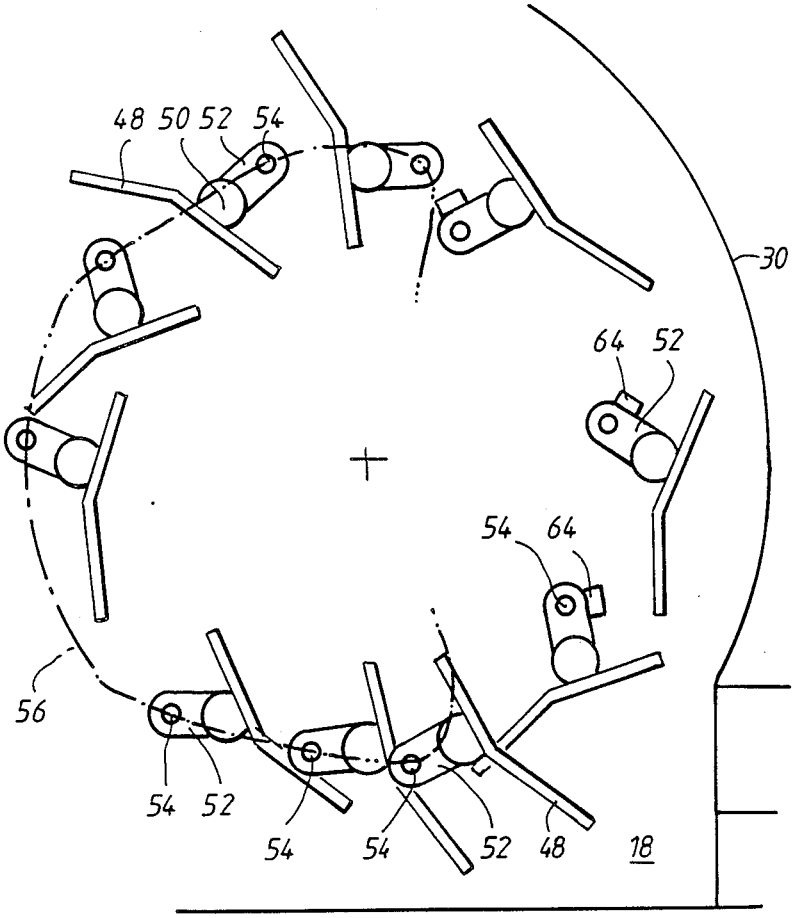
FIG. 4 illustrates how the angle of attack of the paddles can be varied.

In the drawings the operation of the paddle wheel 32 can be readily understood. Motor 42 rotates paddle wheel 32 in the anti-clockwise direction as shown by the arrow in FIG. 2. At the "12 o'clock" position of cam track, a respective cam follower 54 of a paddle 48, will be guided into the cam track. Once in the cam track the orientation of paddle 48 will be controlled and the changes in paddle position are shown in FIG. 4. Between the "12 o'clock" and "9 o'clock" positions the paddles will force the concrete within the unit downwardly. After the "9 o'clock" position has been passed the concrete is then forced towards mould box 22. Accordingly the concrete mix is forced out the mould box to press against the ground revealed by the bottom opening 24 thus lifting the rear of the unit off the ground so that the movement of paddles 48 against the resisting concrete mix causes the unit to move a short distance forward. Providing the operator adjusts the telescoping assemblies 66 during progress, so that the wheels 68 follow ground irregularities, the remainder of the unit will be maintained at the desired inclination and level. At the "6 o'clock" position cam track 56 ends and so the cam followers 54 are released from the cam track and the paddles are free to rotate. The paddles will tend to maintain their position in view of being stuck in the concrete mix but will be forced to adopt a clockwise rotation in view of the rotation of disks 34,36. At about the "4 o'clock" position radial arm 52 will contact stop member 64. In this position any upward migration of concrete from mould box 22 will be restricted. Beyond this position radial arm 52 will abut stop member 64 until the "12 o'clock" position is again reached.

From the above the "angle of attack" of paddles 48 is controlled by the shape of the cam track and can be varied to suit requirements. The cam track may be longer or shorter and can be readily optimized. Although only one paddle wheel has been shown it is clear that a plurality of paddle wheels may be used. It is also clear that the number of paddles can be altered and the shape of the paddles themselves can also be changed. In producing the kerbing in the illustrated embodiment paddle 48 has an extension 70 to assist in formation of the vertical leg 26. In the illustrated embodiment concrete is supplied through open top 20 but other embodiments have the concrete entering the front of the unit e.g. moving unit along a trail of concrete.

In other preferred embodiments the unit may include a vibrator unit to further enhance the compaction of the concrete. If required an ancillary hopper could be provided to supply grout topping to the formed mix. Axle 40 may also be adjusted vertically and/or horizontally by adjusting means (not shown) for further flexibility in operation.

It is clear that the controlled nature of paddles 48 provides a constant thrust against the formed concrete mix and that a "backward" thrust will not occur as happens on withdrawal of the ram plate in the prior art. Accordingly a more consistent and uniform density concrete mix will be formed.

It is believed that the invention and many of its attendant advantages will be understood from the foregoing description and it will be apparent that various changes may be made in the form, construction and arrangement of the parts and that changes may be made in the form, construction and arrangement of the unit described without departing from the spirit and scope of the invention or sacrificing all of its material advantages, the form hereinbefore described being merely a preferred embodiment thereof.

The claims defining the invention are as follows:

1. A unit for molding moldable material, especially concrete mix, asphalt or similar flowable material, the unit comprising:

(a) paddle wheel means for consolidating and propelling moldable material in the unit, said paddle wheel means being rotatably mounted within the unit, said paddle wheel means including generally opposing, rotatable support members to which are pivotably mounted a plurality of paddle assemblies, said paddle assemblies being mounted in a generally circumferentially spaced manner onto said rotatable supports, each said paddle assembly including a paddle and a cam follower;

(b) driving means for rotating said paddle wheel means including its rotatable support members;

(c) a ramming chamber for receiving moldable material from said paddle wheel means, said ramming chamber having a discharge end;

(d) a mold having a receiving end in communication with said discharge end of the ramming chamber, said mold further having a discharge end for permitting outflow of molded material from the unit; and (e) camming means including said cam followers of the paddle wheel means and a cam track positioned on said unit for receiving said cam followers, said camming means combining with said paddle wheel means for varying the angular orientation of each blade with respect to the paddle wheel means in order to define an angle of attack for each blade which varies as the paddle wheel means moves with respect to the cam track.

2. The unit as claimed in claim 1, wherein each paddle has a free end with an extension to provide a paddle free end that is shaped to provide a desirous cross-sectional outline for said moldable material.

3. The unit as claimed in claim 1, wherein said paddle wheel means are for forcing the material downwardly and into said mold.

4. The unit as claimed in claim 1 wherein said paddles are constrained by said cam track only on their downward movement.

5. The unit as claimed in claim 1, herein each paddle is an obtusely angled member.

* * * * *